US011538623B2

(12) United States Patent
Tamura

(10) Patent No.: US 11,538,623 B2
(45) Date of Patent: Dec. 27, 2022

(54) COIL COMPONENT, ELECTRONIC COMPONENT, AND ELECTRONIC APPARATUS

(71) Applicant: SONY CORPORATION, Tokyo (JP)

(72) Inventor: Naoki Tamura, Tokyo (JP)

(73) Assignee: SONY CORPORATION, Tokyo (JP)

( * ) Notice: Subject to any disclaimer, the term of this patent is extended or adjusted under 35 U.S.C. 154(b) by 948 days.

(21) Appl. No.: 16/086,258

(22) PCT Filed: Jan. 26, 2017

(86) PCT No.: PCT/JP2017/002650
§ 371 (c)(1),
(2) Date: Sep. 18, 2018

(87) PCT Pub. No.: WO2017/169044
PCT Pub. Date: Oct. 5, 2017

(65) Prior Publication Data

US 2020/0294710 A1 Sep. 17, 2020

(30) Foreign Application Priority Data

Mar. 28, 2016 (JP) ..... JP2016-063174

(51) Int. Cl.
*H01F 27/29* (2006.01)
*H01F 27/28* (2006.01)
*H01F 30/06* (2006.01)

(52) U.S. Cl.
CPC ..... *H01F 27/29* (2013.01); *H01F 27/2828* (2013.01); *H01F 30/06* (2013.01)

(58) Field of Classification Search
CPC .... H01F 27/29; H01F 27/292; H01F 27/2828; H01F 30/06; H01F 5/04; H01F 2027/297
USPC ..... 336/192
See application file for complete search history.

(56) References Cited

U.S. PATENT DOCUMENTS 4,092,622 A * 5/1978 Widemann ..... H01F 5/04 439/871
4,728,916 A * 3/1988 Fontecchio ..... H01F 7/1607 335/278
6,411,528 B1 * 6/2002 Yasumura ..... H02M 3/33561 363/19
2009/0128278 A1 * 5/2009 Prinsloo ..... H01F 27/40 336/220
2009/0212896 A1 8/2009 Tamura et al.
(Continued)

FOREIGN PATENT DOCUMENTS

DE 3910750 A * 10/1990 ..... H01F 5/04
DE 102011118293 A1 * 5/2013 ..... H01F 41/076
(Continued)

OTHER PUBLICATIONS

Office Action for CN Patent Application No. 201780018714.7, dated Aug. 3, 2020, 06 pages of Office Action and 09 pages of English Translation.
(Continued)

*Primary Examiner* — Tszfung J Chan
(74) *Attorney, Agent, or Firm* — Chip Law Group

(57) ABSTRACT

A coil component including a terminal for external connection to which a plurality of secondary-side winding wires are connected, and a gathering member that gathers vicinities of terminal ends of the plurality of winding wires.

8 Claims, 5 Drawing Sheets

(56) References Cited

U.S. PATENT DOCUMENTS

| | | | | |
|---|---|---|---|---|
| 2014/0016371 | A1* | 1/2014 | Chandrasekaran | H01F 27/28 363/21.12 |
| 2015/0097646 | A1 | 4/2015 | Park et al. | |
| 2015/0289423 | A1 | 10/2015 | Imahori et al. | |

FOREIGN PATENT DOCUMENTS

| | | | | |
|---|---|---|---|---|
| EP | 1713097 | A1 | | 10/2006 |
| JP | 08-115829 | A | | 5/1996 |
| JP | 2000-124037 | A | | 4/2000 |
| JP | 2000124037 | A | * | 4/2000 |
| JP | 2001-345222 | A | | 12/2001 |
| JP | 2006-033987 | A | | 2/2006 |
| JP | 2009-105342 | A | | 5/2009 |
| JP | 2009-218425 | A | | 9/2009 |
| JP | 2009218425 | A | * | 9/2009 |

OTHER PUBLICATIONS

International Search Report and Written Opinion of PCT Application No. PCT/JP2017/002650, dated Apr. 18, 2017, 09 pages.

Office Action for CN Patent Application No. 201780018714.7 dated Aug. 3, 2020, 6 pages of Office Action and 9 pages of English Translation.

Office Action for CN Patent Application No. 201780018714.7, dated May 7, 2022, 05 pages of English Translation and 08 pages of Office Action.

* cited by examiner

COIL COMPONENT, ELECTRONIC COMPONENT, AND ELECTRONIC APPARATUS

CROSS REFERENCE TO RELATED APPLICATIONS

This application is a U.S. National Phase of International Patent Application No. PCT/JP2017/002650 filed on Jan. 26, 2017, which claims priority benefit of Japanese Patent Application No. JP 2016-063174 filed in the Japan Patent Office on Mar. 28, 2016. Each of the above-referenced applications is hereby incorporated herein by reference in its entirety.

TECHNICAL FIELD

The present technology relates to a coil component, an electronic component, and an electronic apparatus.

BACKGROUND ART

In recent years, an electronic apparatus such as a television device and a smartphone is being made thinner, and accordingly, a power supply circuit board and inner structural components (electronic components) are also being made thinner. A transformer is used as one of such structural components (for example, see Patent Literature 1 below). In such a transformer, it is usual practice to perform soldering with a terminal end of a secondary-side winding wire secured to a terminal (pin).

CITATION LIST

Patent Literature 1: JP 2009-218425A

DISCLOSURE OF INVENTION

Technical Problem

Since a large current flows in a transformer depending on the application, it is necessary to adapt to a large current by increasing the wire diameter of a secondary-side winding wire, increasing the number of bundles, or connecting a plurality of winding wires in parallel. However, in the case of connecting the terminal end of a winding wire to a terminal in this manner, thickening of a secured point may cause that point and an adjacent terminal to come into contact and cause a short circuit. In addition, a plurality of winding wires may fall apart to come into contact. If the interval between terminals is increased in order to avoid this, a problem arises in that the transformer increases in size.

Therefore, the present technology has an object to provide a coil component, an electronic component, and an electronic apparatus that are adaptable to a large current and reduced in size.

Solution to Problem

To solve the above-described problem, the present technology is, for example, a coil component including: a terminal for external connection to which a plurality of secondary-side winding wires are connected; and a gathering member configured to gather vicinities of terminal ends of the plurality of winding wires.

In addition, the present technology is, for example, an electronic component including: a winding body part around which a plurality of winding wires are wound; and a gathering member configured to gather vicinities of terminal ends of the plurality of winding wires so as to be laminated in a winding direction.

In addition, the present technology is, for example, an electronic apparatus including: a first functional block; a second functional block; and a transformer including a first secondary-side winding wire configured to supply a first current to the first functional block and a second secondary-side winding wire configured to supply a second current larger than the first current to the second functional block.

Advantageous Effects of Invention

According to at least one embodiment of the present technology, a coil component that is adaptable to a large current can be reduced in size. Note that effects described herein are not necessarily limited, but any effect described in the present technology may be obtained. In addition, the contents of the present technology should not be construed limitedly by the illustrated effects.

MODE(S) FOR CARRYING OUT THE INVENTION

Hereinafter, an embodiment(s) of the present technology and the like will be described with reference to the drawings. Note that description will be provided in the following order.

1. One Embodiment

2. Variants

An embodiment(s) and the like which will be described below are suitable specific examples of the present technology, and the contents of the present technology are not limited to these embodiment(s) and the like. Note that description of sizes, materials, shapes, their relative arrangement, directions such as vertical and horizontal, and the like of structural components described in one embodiment and the like are not intended to limit the scope of the present technology only to them, but are mere description examples unless there is particularly limiting description.

1. One Embodiment

Structural Example of Transformer

1. One Embodiment

Structural Example of Transformer

Figure 1A:
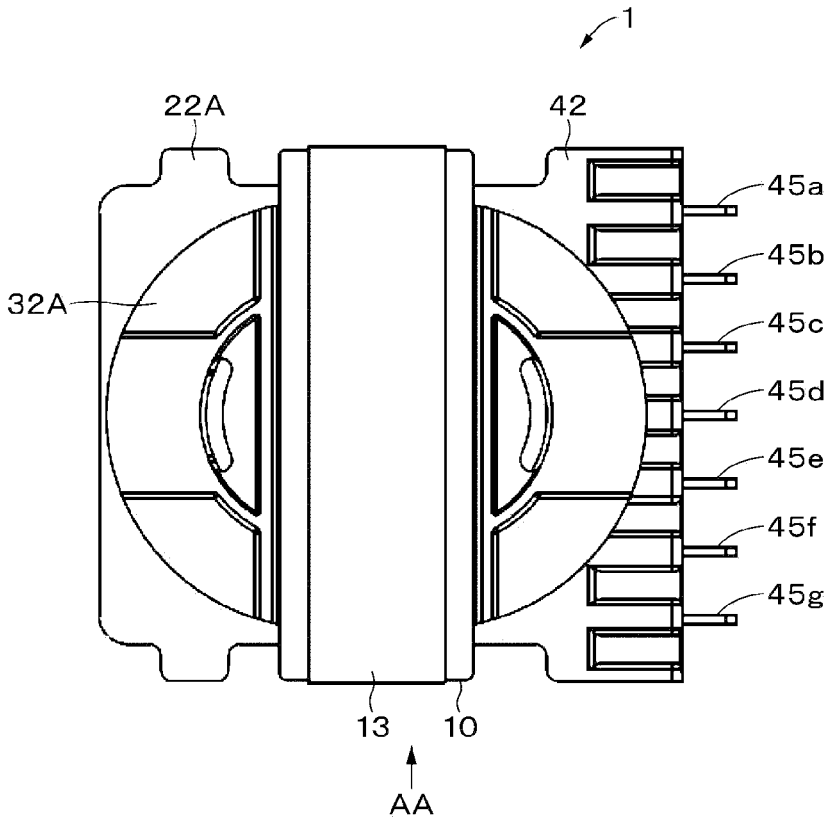
FIG. 1A is a plan view of a transformer according to one embodiment of the present technology.
Figure 1B:
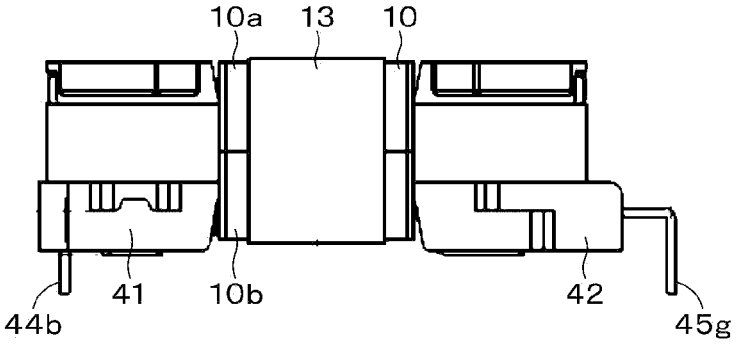
FIG. 1B is a side view of the transformer as seen from a direction of an arrow AA in FIG. 1A.
Figure 2:
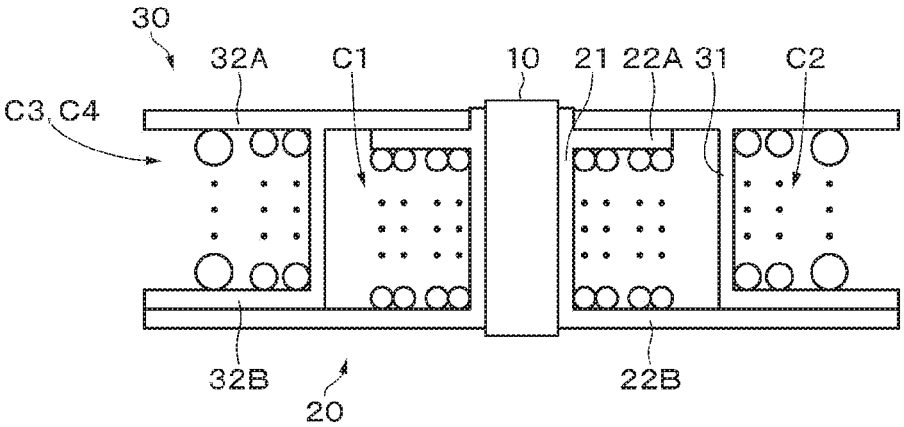
FIG. 2 is a diagram showing a partial structure of the transformer according to one embodiment the present technology.

In one embodiment which will be described below, a transformer for use in a thin television device as a coil component will be described as an example. FIGS. 1A and 1B show diagrams for describing a structural example of a transformer 1 according to one embodiment, in which FIG. 1A is a top view of the transformer 1, and FIG. 1B is a side view as seen from a direction of an arrow AA in FIG. 1A. In addition, FIG. 2 is a diagram showing a partial structure of the transformer.

The transformer 1 includes a core 10, a primary-side bobbin 20, a secondary-side bobbin 30, terminal plates 41, 42, and a gathering member 50, for example. A primary-side winding wire is wound around the primary-side bobbin 20, and a secondary-side winding wire is wound around the secondary-side bobbin 30.

The core 10 includes a first core 10*a* and a second core 10*b*. The first and second cores 10*a* and 10*b* include E-type cores, for example, and are arranged such that the respective leg parts of the first and second cores 10*a* and 10*b* are opposite to each other. The respective middle legs of the first and second cores 10*a* and 10*b* are inserted into holes formed generally at the center of the transformer 1.

As a material of the core 10, a magnetic substance such as ferrite can be used. Depending on the application of the transformer 1, it is also possible to change the material of the core 10 from ferrite to a silicon-containing material such as a highlight material, an orient material, or an amorphous material, and permalloy or the like can also be used as the material of the core 10.

The primary-side bobbin 20 includes a cylindrical winding body part 21, an elliptical collar part 22A formed on one end side of the winding body part 21, and a flat-plate-like collar part 22B formed on the other end side of the winding body part 21.

The secondary-side bobbin 30 includes a cylindrical winding body part 31, an elliptical collar part 32A formed on one end side of the winding body part 31, and a flat-plate-like collar part 32B formed on the other end side of the winding body part 31. Examples of materials of the primary-side and secondary-side winding body parts 20 and 30 can include polyethylene terephthalate, phenolic resin, polybutylene terephthalate, polyethylene, and the like.

As shown in FIG. 2, the collar part 22A and the collar part 32A are arranged so as to be partially laminated, and the collar part 22B and the collar part 32B are arranged so as to be partially laminated. By winding an exterior tape 13 around the outer peripheral surface of the core 10, for example, the respective components of the transformer 1 are integrated. Note that the model number of the transformer 1 and the like can be printed on the surface of the exterior tape 13.

A primary winding wire (primary coil) C1 including an insulation coated wire or the like such as a litz wire or stranded wire is wound around the winding body part 21 by a predetermined number of turns. A secondary-side winding wire such as a litz wire or stranded wire is wound around the winding body part 31 by a predetermined number of turns. In the present embodiment, a secondary winding wire (secondary coil) C2, a tertiary winding wire (tertiary coil) C3, and a quaternary winding wire (quaternary coil) C4 are wound around the winding body part 31.

The terminal plate 41 and the terminal plate 42 are attached to the both ends of the collar part 22B in the lateral direction. The terminal plates 41 and 42 may be configured integrally with the collar part 22B or the like, or may be freely removable. The terminal plate 41 and the terminal plate 42 are provided with a predetermined number of terminals 44 and 45, respectively. In the present embodiment, the terminal plate 41 is provided with two linear terminals 44*a* and 44*b* in a manner extending downward. In addition, the terminal plate 42 is provided with seven terminals 45*a*, 45*b*, . . . , 45*g* having a generally L-shape in a manner protruding to the outside (the outside of the winding body part 21 in the axial direction) and having the leading ends extending downward. The terminals 44 and 45 include copper, copper alloy, or the like. The terminals 45 to which the secondary-side winding wires are connected are used as terminals whose polarity corresponds to the ground (GND) in accordance with the control system of the transformer 1.

The gathering member 50 is a member that gathers vicinities of terminal ends of a plurality of secondary-side winding wires. As the material of the gathering member 50, an electrically conductive member such as metal (for example, aluminum) can be used. Note that illustration of the gathering member 50 is omitted in FIGS. 1A 1B and 2, and details of the gathering member 50 will be described later.

As to Secondary-Side Winding Wires

Next, secondary-side winding wires for use in the transformer 1 will be described in detail. The present embodiment adopts a structure in which a plurality of types of winding wires are used as the secondary-side winding wires to enable a plurality of outputs (multi-output). The secondary winding wire C2 is adaptable to 60V (volt) output, for example, and is used as one example for a power supply for a backlight which is one of functional blocks of an electronic apparatus such as a television device, for example. In the case of this application, the need for adapting the secondary winding wire C2 to a large current is not very high. On the other hand, the tertiary winding wire C3 and the quaternary winding wire C4 are adaptable to 12V output, for example, and are connected to terminals to which an external apparatus for universal serial bus (USB) or the like is connected, and are thus used for various applications. In the case where there are a plurality of terminals for USB or the like, a functional block for supplying a sufficient current to all of these terminals for USB or the like requires a large current. Thus, the need for adapting the tertiary winding wire C3 and the quaternary winding wire C4 to a large current is higher than the secondary winding wire C2.

To address such a need, it is considered to increase the wire diameter of the tertiary winding wire C3 and the quaternary winding wire C4 to become thick, whilst a problem caused by thickening of the winding wires may arise as described above. Therefore, the present embodiment adopts a structure in which the tertiary and quaternary winding wires C3 and C4 include a plurality of (for example, three) winding wires (wire rods), and the terminal ends of the plurality of winding wires are gathered by the gathering member 50. With this structure in which lead wires are connected in parallel, a current flowing in one winding wire can be reduced, and ultimately, a current obtained by combining (adding) currents flown in the respective winding wires can be output from the terminal. In addition, since the winding wires do not become thick, it is possible to prevent the difficulty in winding the winding wires around the bobbins. Note that it is preferable to equalize the three winding wires in wire diameter in order to prevent current fluctuation.

As to Example of Connection

Figure 3:
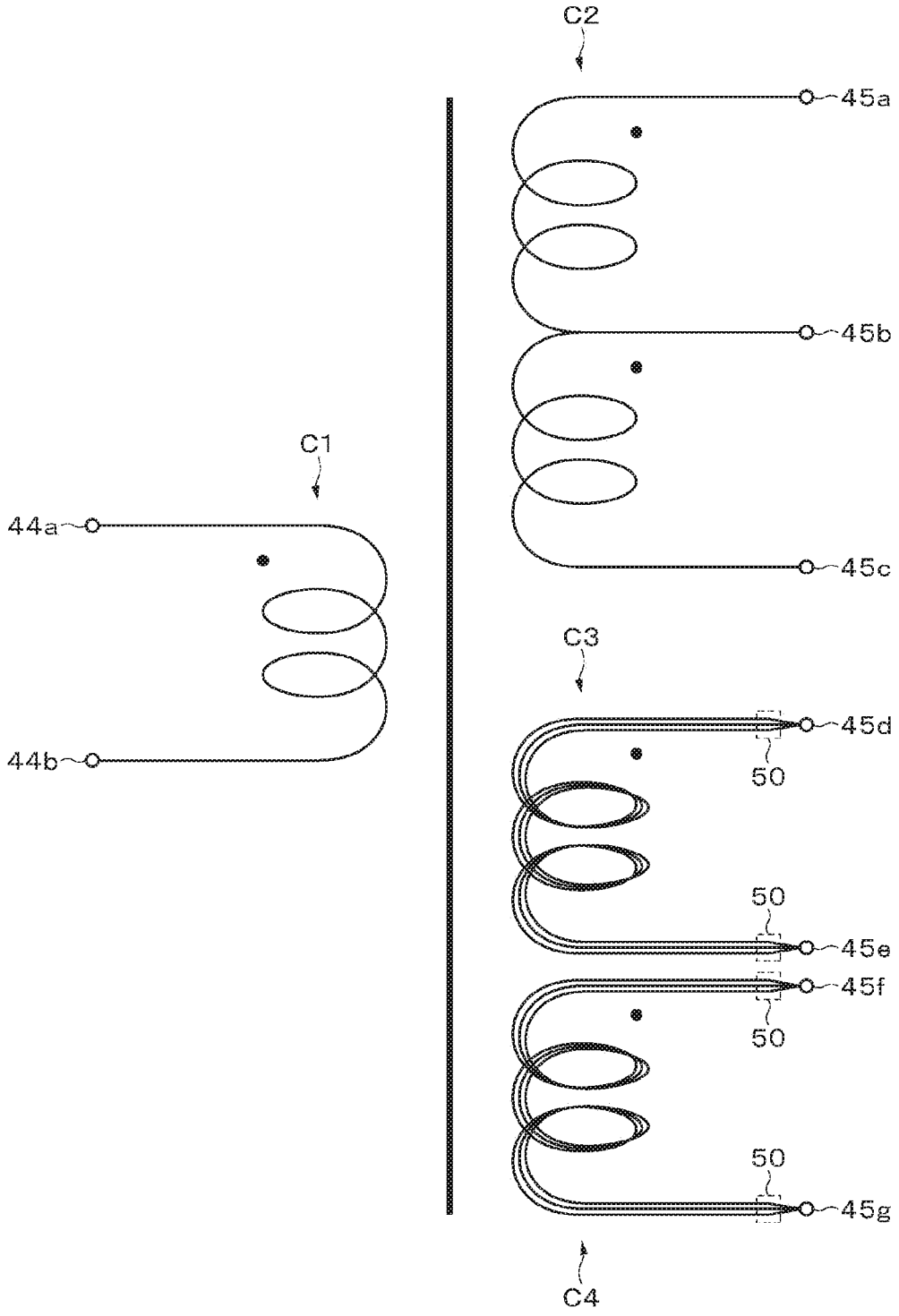
FIG. 3 is a diagram for describing an example of connection of winding wires in the transformer according to one embodiment of the present technology.

FIG. 3 is a diagram showing an example of connection of the winding wires in the transformer 1. The starting point (start of winding) and end point (end of winding) of the primary winding wire C1 are connected to the terminals 44*a* and 44*b*, respectively, by soldering or the like. The starting point and end point of the secondary winding wire C2 are connected to the terminals 45*a* and 45*c*, respectively, and the center tap is connected to the terminal 45*b*, for example.

Vicinities of terminal ends (the starting point and end point) of the tertiary winding wires C3 including three winding wires are gathered by the gathering member 50, and are connected to the terminals 45*d* and 45*e*, respectively. Note that, in the vicinities of the terminal ends of the tertiary winding wires C3, an insulation coating material is peeled. Similarly, vicinities of terminal ends of the quaternary winding wires C4 including three winding wires are gathered by the gathering member 50, and are connected to the terminals 45*f* and 45*g*, respectively. Similarly to the vicinities of the terminal ends of the tertiary winding wires C3, the insulation coating material is peeled in the vicinities of the terminal ends of the quaternary winding wires C4. Note that the vicinities of the terminal ends may be locations including the starting point or end point of the winding wires.

As to Gathering Member

Next, an example of the gathering member 50 will be described with reference to FIGS. 4A, 4B, 4C, 4D, 5A, 5B, 5C, 5D, 5E, 5F, 5G, and 5H. Note that, in the following description, an example of gathering the vicinities of the end points of the tertiary winding wires C3 in the vicinity of the terminal 45*e* for connection to the terminal 45*e* will be described, whilst matters which will be described below can also be applied similarly to the case of gathering the vicinities of the starting points of the tertiary winding wires C3 for connection to the terminal 45*d* or the case of gathering the vicinities of the terminal ends of the quaternary winding wires C4 for connection to the terminal 45*f* and the terminal 45*g*.

Figure 4A:
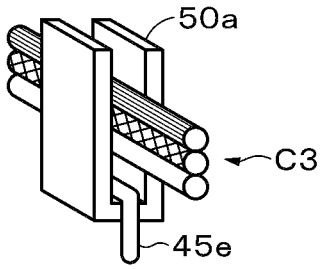
FIGS. 4A, 4B, 4C, and 4D are diagrams for describing examples of a gathering member according to one embodiment of the present technology.

FIG. 4A is a diagram showing the gathering member 50*a* which is an example of the gathering member. The gathering member 50*a* is a fitting having a generally U-shape cross section. The vicinities of the end points of the tertiary winding wires C3 and the terminal 45*e* are inserted into the inner space of the gathering member 50*a* partitioned by the gathering member 50*a*, and the gathering member 50*a* is caulked to the inner side. Accordingly, the locations at which the insulation coating of the winding wires is peeled and the terminal 45*e* are brought into contact to make electric connection. Note that electric connection may be made by soldering each of the winding wires and the terminal 45*e*.

Figure 4B:
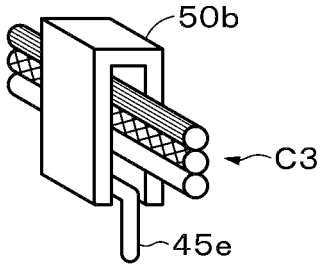

FIG. 4B is a diagram showing a gathering member 50*b* which is another example of the gathering member. The gathering member 50*b* is a fitting having an inverted U-shape cross section. Similarly to the gathering member 50*a*, the vicinities of the end points of the tertiary winding wires C3 and the terminal 45*e* are inserted into the inner space partitioned in the gathering member 50*b*, and the gathering member 50*b* is caulked to the inner side. Accordingly, the locations at which the insulation coating of the winding wires is peeled and the terminal 45*e* are brought into contact to make electric connection.

Figure 4C:
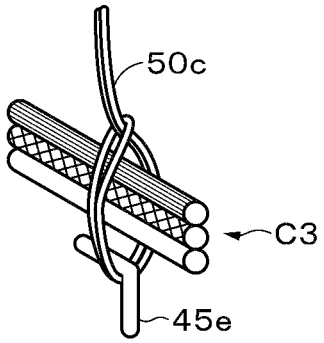

FIG. 4C is a diagram showing a gathering member 50*c* which is another example of the gathering member. The gathering member 50*c* is a wire member including wire metal (lead wire) or the like. By binding the vicinities of the terminal ends of the tertiary winding wires C3 and the terminal 45*e* by the gathering member 50*c* so as to be tied together, the locations at which the insulation coating of the winding wires is peeled and the terminal 45*e* are brought into contact to make electric connection.

Figure 4D:
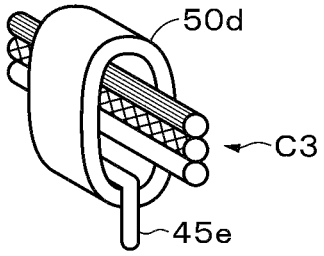

FIG. 4D is a diagram showing a gathering member 50*d* which is another example of the gathering member. The gathering member 50*d* is a fitting having a circular cross section or an elliptical cross section, and having a hollow part. The vicinities of the end points of the tertiary winding wires C3 and the terminal 45*e* are inserted into the hollow part of the gathering member 50*d*, and the gathering member 50*d* is caulked to the inner side. Accordingly, the locations at which the insulation coating of the winding wires is peeled and the terminal 45*e* are brought into contact to make electric connection.

As described above, even in the case where the tertiary winding wires C3 and the like include a plurality of winding wires in order to adapt to a large current, the vicinities of their terminal ends are gathered by the gathering member 50, and thus, it becomes possible to reliably connect and fix the winding wires and the terminal without the respective winding wires being released.

The examples shown in FIGS. 4A, 4B, 4C, and 4D are examples in which the terminals 45 and the gathering member 50 are separate bodies, whilst the terminals 45 and the gathering member 50 may be integrated. FIGS. 5A, 5B, 5C, 5D, 5E, 5F, 5G, and 5H are diagrams showing a plurality of examples of the gathering member 50 integrated with the terminals 45 (for example, 45*e*), that is, the gathering member 50 also functioning as the terminals 45.

Figure 5A:
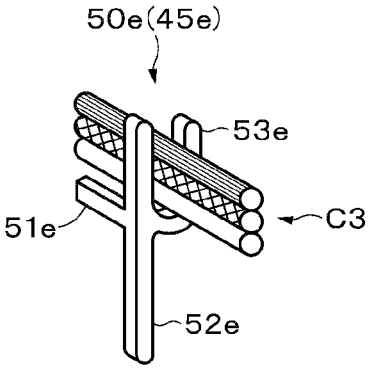
FIGS. 5A, 5B, 5C, 5D, 5E, 5F, 5G, and 5H are diagrams for describing other examples of a gathering member according to one embodiment of the present technology.

A gathering member 50*e* shown in FIG. 5A includes a lead-out part 51*e* lead out from the terminal plate 42, a connection part 52*e* extending downward generally perpendicularly from the lead-out part 51*e*, and a gathering part 53*e* extending upward from the connection part 52*e*. The connection part 52*e* is connected to a control substrate not shown, or the like. The gathering part 53*e* presents a generally U-shape, for example. By inserting the vicinities of the end points of the tertiary winding wires C3 into the gathering part 53*e*, and then caulking the gathering part 53*e* to the inner side, electric connection between the tertiary winding wires C3 and the terminal 45*e* is made.

Figure 5B:
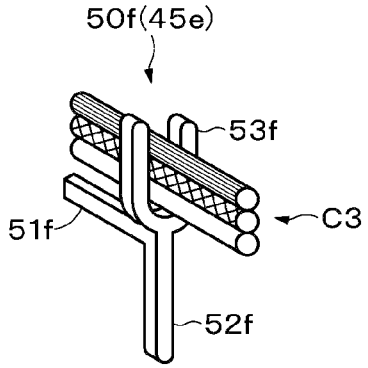

A gathering member 50*f* shown in FIG. 5B presents a shape generally similar to the gathering member 50*e*, and includes a lead-out part 51*f*, a connection part 52*f*, and a gathering part 53*f*. A different point from the gathering member 50*e* lies in the relative positional relationship between the connection part 52*f* and the gathering part 53*f*, and the remaining points are similar to the gathering member 50*e*.

Figure 5C:
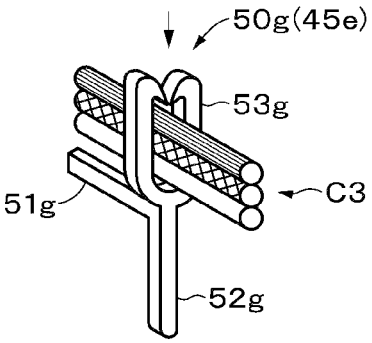

A gathering member 50*g* shown in FIG. 5C includes a lead-out part 51*g* lead out from the terminal plate 42, a connection part 52*g* extending downward generally perpendicularly from the lead-out part 51*g*, and a gathering part 53*g* extending upward from the connection part 52*g*. The gathering part 53*g* is a clip-like member, and a member that allows the vicinities of the terminal ends of the tertiary winding wires C3 to be inserted from above, for example.

By inserting the vicinities of the end points of the tertiary winding wires C3 into the gathering part 53*g*, electric connection between the tertiary winding wires C3 and the terminal 45*e* is made. With this structure, it is possible to electrically connect the tertiary winding wires C3 and the terminal 45*e* without caulking the gathering member.

Figure 5D:
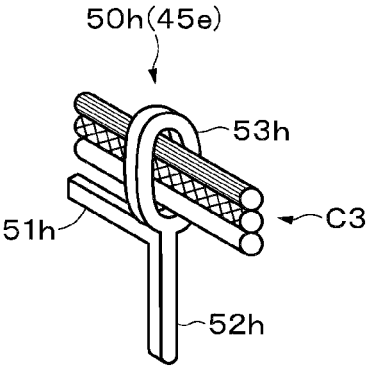

A gathering member 50*h* shown in FIG. 5D includes a lead-out part 51*h* lead out from the terminal plate 42, a connection part 52*h* extending downward generally perpendicularly from the lead-out part 51*h*, and a gathering part 53*h* extending upward from the connection part 52*h*. The gathering part 53*h* presents a ring shape having a hollow part, for example. By inserting the vicinities of the end points of the tertiary winding wires C3 into the hollow part of the gathering part 53*h*, and then caulking the gathering part 53*h* to the inner side, electric connection between the tertiary winding wires C3 and the terminal 45*e* is made. Note that, if the size of the hollow part of the gathering part 53*h* is generally the same as the size of the tertiary winding wires C3, it is not necessary to caulk the gathering part 53*h*.

Figure 5E:
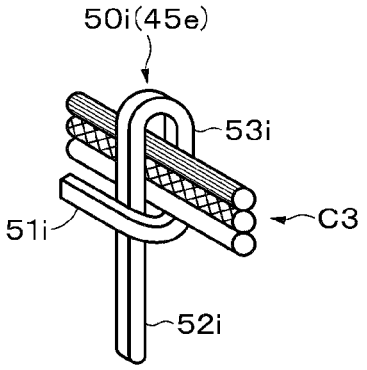
Figure 5F:
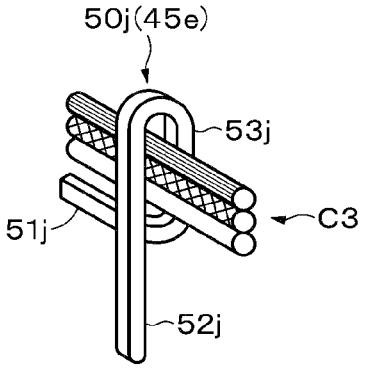

In gathering members 50*i* and 50*j* shown in FIG. 5E and FIG. 5F, a lead-out part 51*i* (a lead-out part 51*j*), a connection part 52*i* (a connection part 52*j*), and a gathering part 53*i* (a gathering part 53*j*) are formed by bending a rod-like member in appropriate directions. By inserting the vicinities of the end points of the tertiary winding wires C3 into the inner side of the gathering part 53*i* (the gathering part 53*j*), and then appropriately caulking the gathering part 53*i* (the gathering part 53*j*) to the inner side, electric connection between the tertiary winding wires C3 and the terminal 45*e* is made.

Figure 5G:
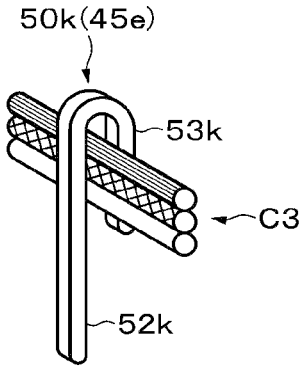

A gathering member 50*k* shown in FIG. 5G is an example of a gathering member having no lead-out part. The gathering member 50*k* has a support 52*k*, and a gathering part 53*k* is formed by bending the upper end of the support 52*k* into a generally U-shape, for example. By inserting the vicinities of the end points of the tertiary winding wires C3 into the inner side of the gathering part 53*k*, and then appropriately caulking the gathering part 53*k* to the inner side, electric connection between the tertiary winding wires C3 and the terminal 45*e* is made. Note that, in the case of the present example, the proximity of the center of the support 52*k*, for example, is supported by the terminal plate 42, and the lower end of the support 52*k* functions as a connection part.

Figure 5H:
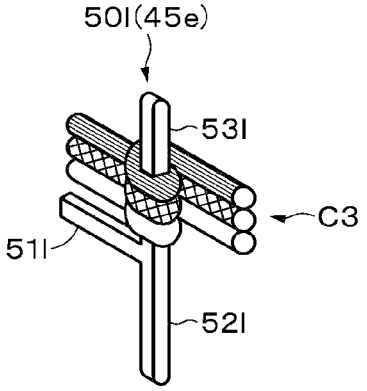

A gathering member 501 shown in FIG. 5H includes a lead-out part 511 lead out from the terminal plate 42 as well as a connection part 521 and a gathering part 531 extending in a generally perpendicular direction from the lead-out part 511, and presents a generally T-shape. By winding the vicinities of the terminal ends of the tertiary winding wires C3 around the gathering part 531, the vicinities of the terminal ends are gathered. In this manner, the vicinities of the terminal ends of the tertiary winding wires C3 may be wound around the gathering member. Note that, as long as the vicinities of the terminal ends of the tertiary winding wires C3 can be wound, the shape of the gathering member 501 can be changed appropriately.

By integrating the gathering member with the terminal as described above, cost reduction because of a reduction in the number of components and simplification of manufacturing steps can be achieved.

Note that, when gathering the vicinities of the terminal ends of the three winding wires included in the tertiary winding wires C3, it is preferable to gather them so as to be laminated in the winding direction of the tertiary winding wires C3, in other words, in the thickness direction of the transformer 1, as illustrated in FIGS. 4A, 4B, 4C, 4D, 5A, 5B, 5C, 5D, 5E, 5F, 5G, and 5H. From another perspective, it is preferable to gather the vicinities of the terminal ends of the three winding wires so as to be laminated in a direction different from the arrangement direction of the terminals 45 for external connection (in the present example, a generally perpendicular direction). In the case of the transformer 1, since the tertiary winding wires C3 and the like are wound around a predetermined bobbin, space is left on the outside of the winding location, specifically, above the terminal plate 42. By gathering the plurality of winding wires utilizing this space effectively, the transformer 1 can be prevented from increasing in size. Note that the plurality of winding wires do not necessarily need to be laminated linearly, but may be laminated and gathered to a degree that fit in the above-described space.

2. Variants

One embodiment of the present technology has been specifically described above, whilst the contents of the present technology are not limited to the above-described embodiment, but various variants based on the technical idea of the present technology are possible.

In the above-described embodiment, an example of gathering the vicinities of the terminal ends of the three tertiary winding wires C3 has been described, whilst the vicinities of the terminal ends of two or four or more tertiary winding wires C3 may be gathered. The same applies to the quaternary winding wires C4.

The secondary winding wire C2 may include a plurality of winding wires, and similarly to the above-described embodiment, the vicinities of the terminal ends of the plurality of winding wires may be gathered. However, since the need for adapting the secondary winding wire C2 to a large current is low as described above, the need for thickening the winding wires or using a plurality of winding wires is also low. Therefore, a structure may be adopted in which a single winding wire is used for the secondary winding wire C2, the winding wire is secured and soldered to the terminal similarly to a general method, and only the vicinities of the terminal ends of the tertiary winding wires C3 and the quaternary winding wires C4 are gathered.

In the coil component according to the present technology, a plurality of gathering members may be used. For example, a structure may be adopted in which the vicinities of the terminal ends of the tertiary winding wires C3 gathered by a metal wire as the gathering member are supported by a clip which is another gathering member and also serves as a terminal.

The winding method and the number of turns of the primary winding wire C1 and the secondary winding wire C2 may be set appropriately. For example, the secondary winding wire C2 may be obtained by so-called bifilar winding of winding two wire rods around the secondary-side bobbin 30 concurrently in the same winding wire direction.

The transformer adapted to a plurality of outputs has been described in the above-described embodiment, whilst a transformer adapted to only one output (voltage) may be adopted. The output value can be set by appropriately changing the number of turns of winding wires or the wire diameter of the winding wires. In addition, the present technology is not limited to a transformer, but also applicable to other electronic components in addition to a coil component such as a choke coil.

The shape of the core 10 can be a shape in accordance with the shape of the transformer, such as a rod-like core, in addition to the E-type core. The shape of the primary-side and secondary-side winding body parts 20 and 30 can also be changed appropriately.

The structures, methods, steps, materials, numeric values, and the like listed in the above-described embodiment are merely examples, and structures, methods, steps, materials, numeric values, and the like different from these may be used according to necessity. In addition, matters described in the embodiment and variants can be combined to each other unless technical inconsistency arises.

Additionally, the present technology may also be configured as below.

(1)

A coil component including:

a terminal for external connection to which a plurality of secondary-side winding wires are connected; and a gathering member configured to gather vicinities of terminal ends of the plurality of winding wires.

(2)

The coil component according to (1), in which the vicinities of the plurality of terminal ends are gathered in a vicinity of the terminal.

(3)

The coil component according to (1) or (2), in which the vicinities of the terminal ends of the plurality of winding wires are gathered so as to be laminated in a winding direction of the winding wires.

(4)

The coil component according to any of (1) to (3), in which the terminal and the gathering member are integrated.

(5)

The coil component according to any of (1) to (4), in which the secondary-side winding wires include a first winding wire in which a first current flows and a second winding wire in which a second current larger than the first current flows, and the second winding wire includes a plurality of winding wires, and the vicinities of the terminal ends of the plurality of winding wires are gathered by the gathering member.

(6)

The coil component according to any of (1) to (5), in which the gathering member includes an electrically conductive member.

(7)

The coil component according to any of (1) to (6), in which the vicinities of the terminal ends of the plurality of winding wires are gathered so as to be laminated in a direction different from an arrangement direction of the terminal for external connection.

(8)

An electronic component including:

a winding body part around which a plurality of winding wires are wound; and a gathering member configured to gather vicinities of terminal ends of the plurality of winding wires so as to be laminated in a winding direction.

(9)

An electronic apparatus including:

a first functional block;

a second functional block; and a transformer including a first secondary-side winding wire configured to supply a first current to the first functional block and a second secondary-side winding wire configured to supply a second current larger than the first current to the second functional block.

(10)

The electronic apparatus according to (9), in which the second functional block includes a plurality of external connection terminals configured to supply currents to a plurality of external connection apparatuses.

REFERENCE SIGNS LIST

1 transformer
45 terminal
50 gathering member
C1 primary winding wire
C3 tertiary winding wire
C4 quaternary winding wire

The invention claimed is:

1. A coil component, comprising:

a terminal plate that includes a terminal for external connection, wherein the terminal is connected to a plurality of secondary-side winding wires; and a gathering member that includes:

a lead-out part that leads out from the terminal plate;

a connection part attached to the lead-out part, wherein the connection part extends in a first direction perpendicular to the lead-out part; and a gathering part that extends from the connection part in a second direction, wherein the gathering part is configured to gather vicinities of a plurality of terminal ends of the plurality of secondary-side winding wires, the second direction is opposite to the first direction, the gathering part has a ring shape with a hollow part, the vicinities of the plurality of terminal ends of the plurality of secondary-side winding wires is insertable into the hollow part of the gathering part, and a size of the hollow part of the gathering part is the same as a size of the plurality of secondary-side winding wires.

2. The coil component according to claim 1, wherein the gathering part is further configured to gather the vicinities of the plurality of terminal ends of the plurality of secondary-side winding wires in a vicinity of the terminal.

3. The coil component according to claim 1, wherein the gathering part is further configured to gather the vicinities of the plurality of terminal ends of the plurality of secondary-side winding wires to laminate the plurality of secondary-side winding wires in a winding direction of the plurality of secondary-side winding wires.

4. The coil component according to claim 1, wherein the terminal is integrated with the gathering member.

5. The coil component according to claim 1, wherein the plurality of secondary-side winding wires includes a first winding wire that carries a first current flows and a second winding wire that carries a second current, the second current is larger than the first current, the second winding wire includes a plurality of winding wires, and the gathering part is further configured to gather the vicinities of the plurality of terminal ends of the plurality of winding wires.

6. The coil component according to claim 1, wherein the gathering member includes an electrically conductive member.

7. The coil component according to claim 1, wherein the gathering part is further configured to gather the vicinities of the plurality of terminal ends of the plurality of secondary-side winding wires such that the plurality of secondary-side winding wires is laminated in a direction different from an arrangement direction of the terminal.

8. An electronic component, comprising:

a winding body part around which a plurality of winding wires is wound;

a terminal plate including a terminal for external connection; and a gathering member that includes:

a lead-out part that leads out from the terminal plate;

a connection part attached to the lead-out part, wherein the connection part extends in a first direction perpendicular to the lead-out part; and a gathering part that extends from the connection part in a second direction, wherein the gathering part is configured to gather vicinities of a plurality of terminal ends of the plurality of winding wires such that the plurality of terminal ends is laminated in a winding direction, the second direction is opposite to the first direction, the gathering part has a ring shape with a hollow part, the vicinities of the plurality of terminal ends of the plurality of winding wires is insertable into the hollow part of the gathering part, and a size of the hollow part of the gathering part is the same as a size of the plurality of winding wires.

* * * * *